United States Patent [19]

Turner

[11] 4,243,853

[45] Jan. 6, 1981

[54] ROTARY CODED SWITCH

[75] Inventor: W. Bard Turner, Lexington, Mass.

[73] Assignee: C & K Components, Inc., Newton, Mass.

[21] Appl. No.: 21,562

[22] Filed: Mar. 16, 1979

Related U.S. Application Data

[63] Continuation-in-part of Ser. No. 894,599, Apr. 7, 1978, abandoned.

[51] Int. Cl.[3] ..... H01H 19/56

[52] U.S. Cl. ..... 200/8 R; 200/11 R; 200/11 G; 200/11 K; 200/155 A

[58] Field of Search ..... 200/8 R, 8 A, 11 R, 200/11 A, 11 D, 11 DA, 11 G, 11 J, 11 K, 11 TW, 155 R, 155 A, 291, 292, 303, 302

[56] References Cited

U.S. PATENT DOCUMENTS

| | | | |
|---|---|---|---|
| 2,100,426 | 11/1937 | Berger | 200/155 A X |
| 2,201,882 | 5/1940 | Bryant et al. | 200/8 R |
| 3,005,881 | 10/1961 | Ellsworth | 200/11 TW |
| 3,226,496 | 12/1965 | Seabury, Jr. | 200/8 R X |
| 3,263,033 | 7/1966 | Metzger | 200/11 K X |
| 3,284,583 | 11/1966 | Buzzi | 200/11 TW |
| 3,311,717 | 3/1967 | Luce | 200/8 R |
| 3,383,478 | 5/1968 | Mandel | 200/8 R |
| 3,512,113 | 5/1970 | Kirkendall | 200/303 X |
| 3,772,485 | 11/1973 | Workings | 200/11 TW |
| 3,781,866 | 12/1973 | Kilby | 307/112 |
| 3,903,383 | 9/1975 | Marker | 200/11 TW |
| 3,944,760 | 3/1976 | Zdanys et al. | 200/6 BB |
| 3,958,090 | 5/1976 | Garcia | 200/67 AA |
| 3,965,319 | 6/1976 | Lockard | 200/310 |
| 3,978,298 | 8/1976 | Fukuda et al. | 200/6 R |
| 3,999,287 | 12/1976 | Lockard | 29/622 |
| 4,000,383 | 12/1976 | Lockard | 200/16 D |
| 4,019,037 | 4/1977 | Monna | 200/155 R X |

OTHER PUBLICATIONS

AMP, Inc., "Programming and Switching Devices--Printed Circuit Board Rotary Switches", Data Sheet No. 74-276, Feb. 1977.

Engineering Company of California, EECO Switch Product Catalog, 1977, pp. 9 and 10.

EECO, 1977, Switch Product Guide of Electronic Engineering Company of California, Santa Ana, Calif. 8 pp.

*Primary Examiner*—James R. Scott

*Attorney, Agent, or Firm*—Weingarten, Maxham & Schurgin

[57] ABSTRACT

A subminiature rotary coded switch having a dual-in-line configuration. Flexible contacts making electrical connection with the dual-in-line terminals of the switch are mounted within a stationary body. A drum-shaped detenting cover has printed circuitry on its inner cylindrical surface, typically in the form of a flexible printed circuit board. The cover rotates the flexible board with respect to the body, producing a wiping action with respect to the flexible contacts, thereby producing the desired switching operations. Each such switch can be electrically equivalent to four single-pole double-throw switches and two of the switches of this invention can be mounted in one conventional 14-terminal dual-in-line array of holes in a printed circuit board.

49 Claims, 9 Drawing Figures

ROTARY CODED SWITCH

CROSS REFERENCE TO RELATED APPLICATION

This is a continuation-in-part of United States patent application Ser. No. 894,599, filed Apr. 7, 1978 now abandoned.

FIELD OF THE INVENTION

This invention relates generally to switches and more particularly to miniature switches in a dual-in-line configuration and having binary coded functions.

BACKGROUND OF THE INVENTION

Miniature switches having a dual-in-line configuration have previously been available, examples of such switches being disclosed in U.S. Pat. Nos. 3,944,760, 3,958,090, 3,965,319, 3,978,298, 3,999,287 and 4,000,383. Other types of switches which have been made in a dual-in-line configuration include rotary switches having a printed circuit board in the shape of a rigid disk, the internal rotating mechanism to which the disk is mounted being rotatable either by means of a knurled rim or a trans-axial slot accessible by means of a screwdriver. One such switch is shown in U.S. Pat. No. 3,903,383.

Switches of the rotating disk type typically have certain disadvantages, among them being that the wiping contacts have different amounts of wear depending upon their radial position with respect to the axis of the disk. Additionally, because the space available for providing separate conductive tracks on a disk is much smaller toward the axis than it is toward the circumference, such switches are sensitive to minute misalignment problems which would alter the effective switch position.

A subminiature binary coded switch having a dual-in-line configuration, similar in size to the switch of the present invention, is sold by Electronic Engineering Company of California under the trade name Micro-Dip. This prior art switch does not employ a printed circuit board but instead has a series of longitudinally stacked cams which selectively open loosely mounted contacts from their associated fixed terminals with which they are normally in contact.

SUMMARY OF THE INVENTION

Broadly speaking, this invention relates to a rotary subminiature binary coded switch. It has distinct advantages over switches of the prior art, in part because it is made of relatively inexpensive parts having reasonable tolerances with commensurate ease of assembly. More specifically it provides a dual-in-line switch which operates with precision and in which the movable parts wear evenly throughout its useful life. A built-in wiping action prevents contamination from adversely affecting the switch contact surfaces.

A body element is molded together with a plurality of electrical terminals which extend longitudinally within the body and project externally in a dual-in-line configuration. Flexible wire form contacts of any desired cross sectional shape are mounted as different vertically spaced locations on the body, each such contact making electrical connection with one of the terminals. A drum-shaped cover having printed circuitry on its cylindrical inner surface is rotatably mounted to the body. The flexible wire form contacts wipe against the inner surface of the printed circuit thereby performing the switching functions desired when the cover is rotated. Cooperative means are included in the body and the cover to provide detenting of the switch to each of its various plurality of positions and to seal the cover to the body while permitting relative rotation between them.

A distinct advantage of the present invention is that all of the wiping contacts get the same amount of wear because they are making contact with a cylindrical surface as opposed to the disk surfaces of prior art switches. The switch may be formed with any practical number of positions, the total being either odd or even as desired for various functions. Further, because of the structure of the switch, it is "splashproof" so that the switch can be wave soldered to a printed circuit board and flux cleaned subsequent to the soldering operation without adverse effect.

BRIEF DESCRIPTION OF THE DRAWING

The objects, advantages and features of this invention will be more readily appreciated from the following detailed description when read in conjunction with the accompanying drawing in which.

DESCRIPTION OF THE PREFERRED EMBODIMENTS

Figure 1:
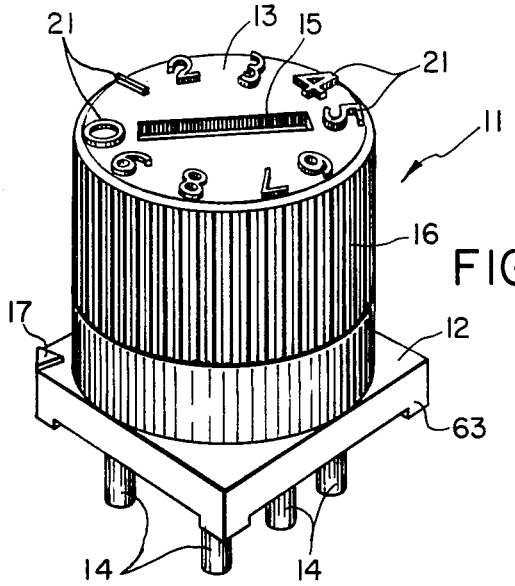
FIG. 1 is a perspective view of a switch made in accordance with the principles of this invention.

With reference now to FIG. 1, there is shown a switch 11 formed of a body member 12 and a cover 13. Terminals 14 extend downwardly from the body in dual-in-line configuration. The cover is formed with a slot 15 and with a knurled, grooved or otherwise roughened external surface 16, by either means of which the cover may be rotated with respect to the body. The body is also formed with a polarity indicator 17 which in this case is a notch in one corner. Any other polarity indicator may be used if desired. Notch 17 also indicates the position of the switch when one of the visual indicia such as numerals 21 is radially aligned with the notch.

Figure 2:
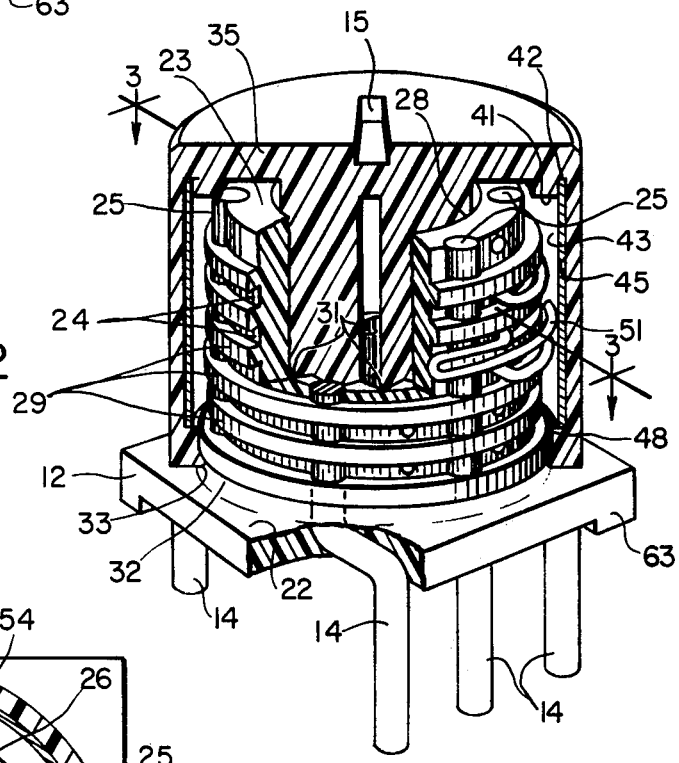
FIG. 2 is a partially cut away perspective view of the switch of FIG. 1.
Figure 3:
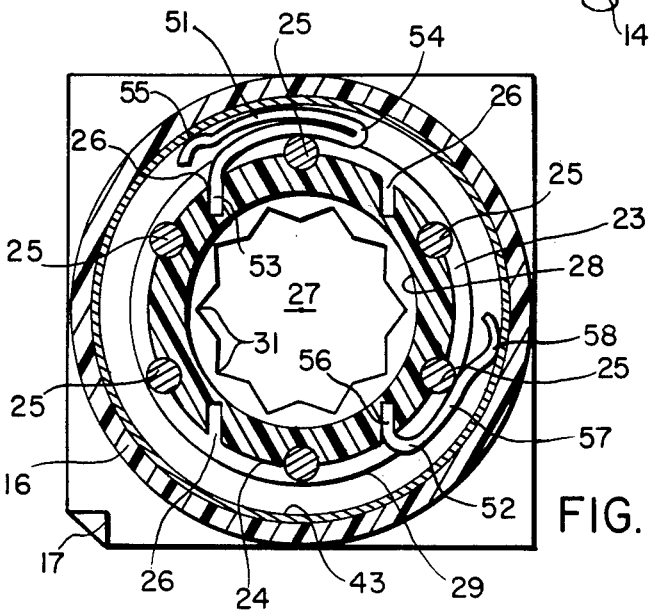
FIG. 3 is a top sectional view taken along cutting plane 3—3 of FIG. 2.
Figure 4:
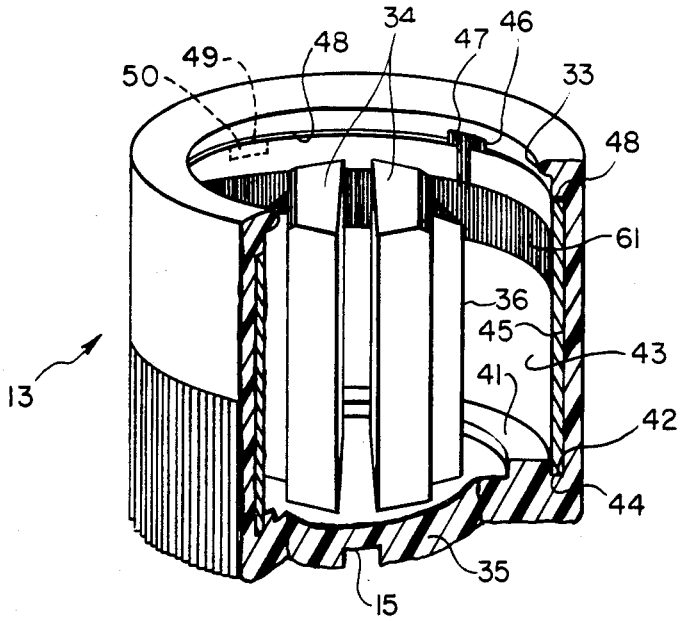
FIG. 4 is a partially broken away perspective view of the inside of the cover of the switch of FIG. 1.

FIGS. 2, 3 and 4 show the detail of the switch structure. Base 22 of body member 12 is a relatively flat rectangular element and formed therewith is an upwardly extending cylindrical core element 23 having a plurality of longitudinally spaced annular grooves 24 alternating with lands 29. Upwardly extending portions 25 of terminals 14 are molded together with the body and specifically with cylindrical core portion 23 such that they are exposed within each of grooves 24.

Chordal holes 26 (FIG. 3) are formed, normally during the molding process, at various locations in grooves 24 angularly spaced from the locations of terminals 25. Core element 23 may include any number of such holes 26 but there is preferably at least one such hole in each annular groove 24. The purpose of these holes will be discussed hereinbelow. The bottom portion of the hollow interior of core element 23 is a multi-faceted opening 27 having outwardly projecting apexes 31. This opening is for detenting purposes as will become apparent. The top portion of the core interior is smooth cylindrical opening 28 which is preferably larger than the faceted portion. Body 12 is formed with means for retaining the cover rotatably mounted thereto. In FIG. 2 this means is shown as an inwardly radially projecting annular groove 32 which is above and adjacent the flat rectangular upper surface of the base.

The cover 13 is molded of relatively flexible electrically insulating material in a cylindrical configuration having one closed end 35 and one open end. At the open end a circumferential inwardly projecting rib 33 is formed which cooperates with groove 32 in the body to enable the cover to be secured to the body in a rotatable manner. This is one practical manner to rotatably seal the cover to the body but other equally effective configurations may be employed. For example, a sealing O-ring or a washer to longitudinally pre-load the elements may be used to provide an effective seal. Or, instead of an inwardly projecting rib fitting into an inwardly projecting groove, both the rib and the groove could be outwardly projecting, or their positions could be reversed. Detent fingers 34 extend longitudinally internally from closed end member 35. These fingers are symmetrical about the axis of the cover, each of the fingers being formed with a projecting apex 36 which functions as a detecting means in cooperation with the facets 31 of central opening 27 in the core. Fingers 34 of the cover engage the facets 31 of the cylindrical element for about one-half of their length adjacent their free ends so that while there is a positive radial detenting action, the cover is indeed relatively rotatable with respect to the body. While two such fingers 34 are shown, it is possible that any suitable member, including one of such fingers, could be used. The closed end 35 of the cover, normally constituting the top of the switch, is formed with blind slot 15 by means of which a screwdriver or other suitable tool may be employed to rotate the cover.

Figure 5:
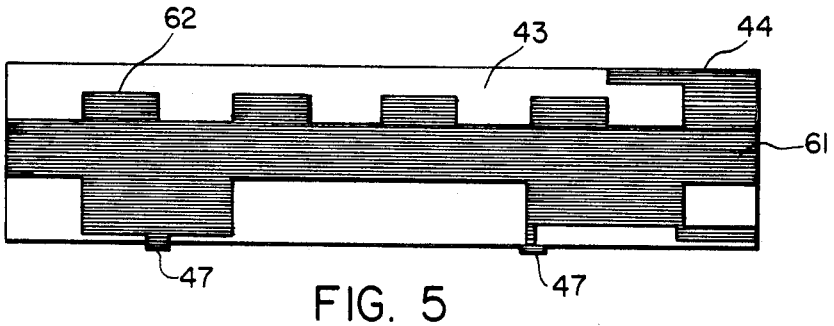
FIG. 5 shows one embodiment of the flexible printed circuit board before being installed in the switch of FIG. 1.
Figure 6:
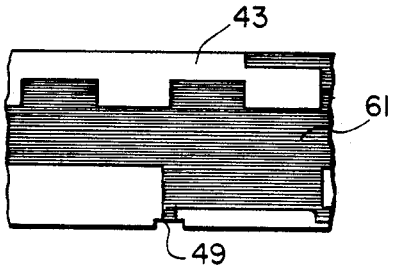
FIG. 6 is a fragmentary view of the circuit board of FIG. 5 with an alternative means for engaging the cover.

An annular ridge 41 projects longitudinally from closed end member 35 parallel to the cylindrical sides of the cover for a short distance thereby defining annular groove 42. Flexible printed circuit board 43 (see FIGS. 4 and 5) has its straight top edge 44 residing in groove 42 and is otherwise generally in contact with the internal cylindrical surface 45 of cover 13. One or more notches 46 may be formed at the bottom of the cover in annular shoulder 48 near the open end adjacent rib 33. A tab 47 on the printed circuit board is engaged in notch 46 to ensure that there is no relative rotation of the circuit board with respect to the cover. Alternatively, the circuit board could be formed as shown in FIG. 6 with notches 49 instead of tabs and the inner surface of the cover could be formed with longitudinally upward projections 50 (shown in dotted lines in FIG. 4) from annular shoulder 48 whereby the projections are received in the notches of the printed circuit board for a similar purpose.

As a further alternative, the printed circuitry could be applied directly to the inner surface of cover 13 thereby simplifying the structure.

Figure 7:
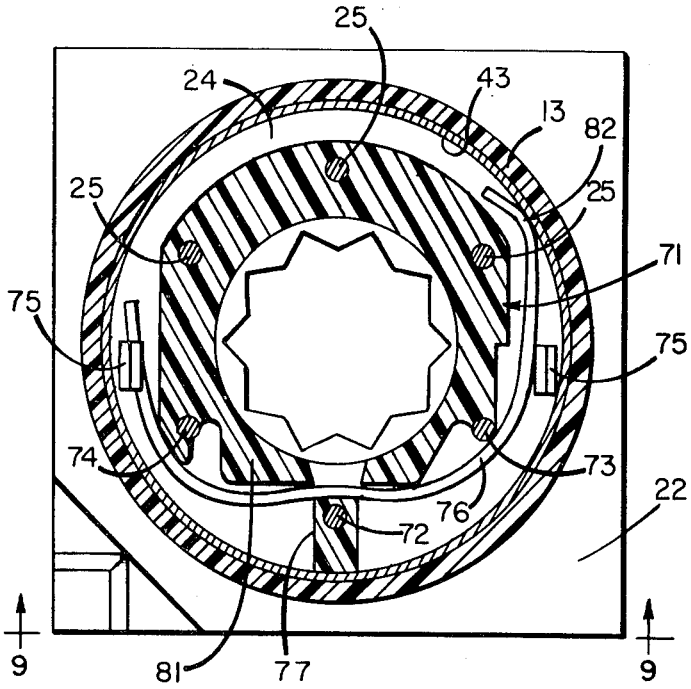
FIG. 7 is a top sectional view similar to FIG. 3 showing an alternative embodiment of the contacts.
Figure 8:
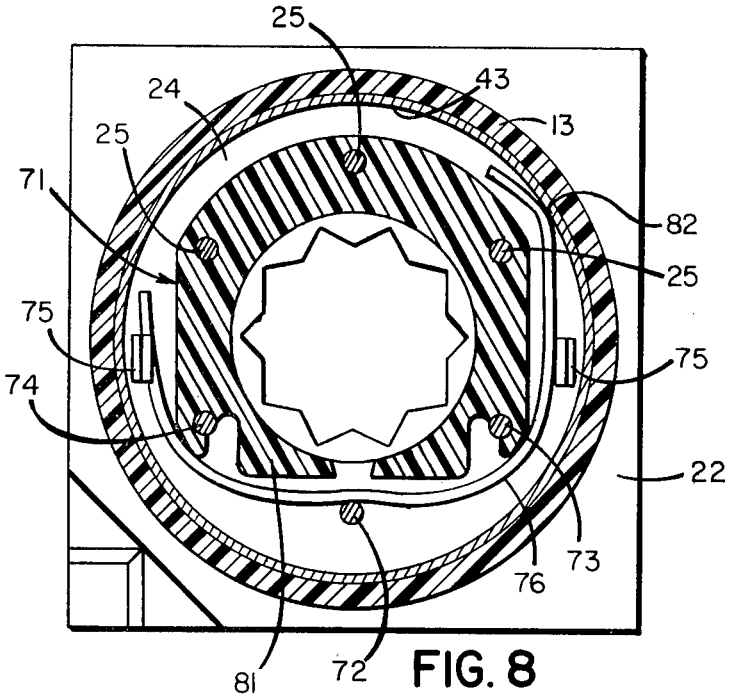
FIG. 8 is a top sectional view similar to FIG. 3 showing an alternative embodiment of mounting the contact of FIG. 7.
Figure 9:
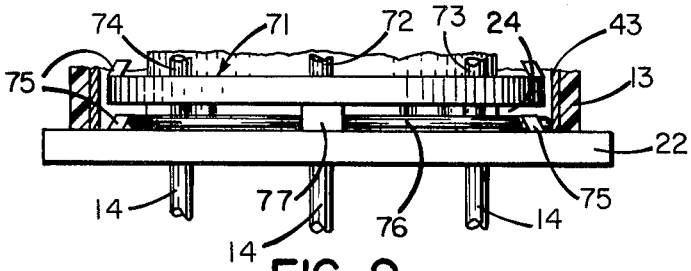
FIG. 9 is a partial side view of FIG. 7.

With particular reference now to FIG. 3, there are shown two flexible wire form contacts 51 and 52 having somewhat different configurations. Contact 51 is formed with a straight projection 53 inserted into one of holes 26, a reverse bend 54 and a printed circuit board contacting surface 55. Contact 52 is formed with a straight portion 56 projecting into one of holes 26, a relatively straight portion 57 and a printed circuit board contacting surface 58. Note that each contact is a spring-like member biased outwardly bearing on one of terminals 25 and engaging the inner surface of printed circuit board 43. Depending upon the configuration of the metalized contact areas of the printed circuit board, each of contacts 51, 52 essentially transfers electrical signals between the circuit board and the terminal. It should be noted that the different configurations of contacts 51, 52 are partially due to the angle of holes 26 relative to the terminal to be contacted. If holes 26 are made by boring instead of molding, they could all be at the same angle relative to each adjacent terminal 25 and only one type of flexible contact would be necessary. Furthermore, similar wiping fingers could be fixed, such as by welding, directly to the terminals so that the relatively loosely confined contacts 51, 52 could be dispensed with. It should be recognized that many other shapes for the wire form contacts may be devised to accomplish the interconnecting or electrical transfer function. They need not have one end inserted into a hole in the core but could be so formed as to be confined within a groove 24 and make the requisite contact between the printed circuitry on the inside of the cover and at least one of terminals 25. Particular examples of such contacts are shown in FIGS. 7–9 which are discussed hereinbelow. Within the confines of the switch of this invention, the contacts are self wiping and keep themselves and the circuit board tracks clean for reliable operation over long periods of time, even when the switch position has not been changed for some time.

The circuit board is generally formed with the same number of horizontal tracks as there are circumferential grooves 24 in the cylindrical core portion of the body and one of contacts 51 and 52 is normally mounted in each such groove in an appropriate position to interconnect a terminal with one of the printed circuit board tracks. The configuration of the printed circuit board is a matter of design as is the position of the flexible contacts, depending upon the particular coding of the switch. A typical circuit board pattern is shown in FIG. 5 where the flexible board is laid flat. Note that there is at least one metalized track 61 in the middle which, when mounted inside cover 13, provides continuous electrical contact with at least one of the flexible contacts 51, 52. This will normally be electrical common or ground. The shaded areas indicate metalization and the clear areas ae not metalized. Each time a metalized segment, such as segment 62, is in electrical contact with one of the flexible contacts, the corresponding terminals 14, 25 is also electrically common with the terminal or terminals which are continuously in contact with track 61. The flexible contacts, which are outwardly biased, are relatively loosely confined by the inner surface of the printed circuit board within the cover.

As is evident in FIGS. 7–9, it is not necessary that there be holes in the core element to receive an end of a wire form contact. FIG. 7 shows one groove 24 in core 71 having several terminals 25, 72, 73 and 74 extending longitudinally therethrough. In this configuration, each groove is formed with one or more projections 75 over which wire form contact 76 is snapped into the groove to hold it in place prior to being confined within cover 13 at final assembly. In this embodiment, the contact 76 is inserted between insulating post 77 in which terminal 72 is confined, and core element 81. The ends are then snapped over projections 75 and the contact is radially confined within the groove by the projections as shown in FIG. 9. When the cover is assembled to the core, knee 82 of the contact engages the inner surface of printed circuit board 43 and terminal 73 is also engaged by the contact.

Note that core element 81 is D-shaped. This D-shape may be oriented in any direction, that is, rotated with respect to the orientation of FIG. 7 any number of degrees so that contact 76 engages any desired one of terminals 25, 73 or 74. Of course, the number of terminals can also be varied as necessary for any application.

The embodiment of FIG. 8 is very similar to that of FIG. 7, the primary difference being that post 77 has been removed and terminal 73 is insulated from contact 76. The contact is inserted in the same manner but it now engages terminal 72 instead of terminal 73.

As particular examples of the materials from which the invention is made, and not by way of limitation, electrical terminals 14 are made of gold plated brass. The terminals are preferably round and would normally be approximately 0.015 inch (0.381 mm) in diameter. The body is normally insert molded together with the terminals and is made of relatively rigid plastic such as Ryton 4. The particular material used for molding the body should be able to be molded with relatively small parts without the need for deflashing around the molded-in contacts, and withstand the relatively high temperatures occurring during soldering operations without deformation. The cover may be formed of glass-filled nylon or a glass filled polyester such as Valox which has sufficient flexibility to enable the spring fingers to perform their detenting functions and to enable the cover to be snapped onto the body in a self-sealing fashion. The contacts 51, 52 are very small, between 0.01 and 0.02 inch (0.254 and 0.508 mm) long and are made of a precious metal alloy, a particular example being Paliney 7. Any material which has a very good film resistance and a good physical memory such that its spring action does not degrade over a period of time and use would be satisfactory for these contacts. The circuit board is preferably made of a dielectric such as Kapton having a thickness of 0.003 inch (0.0762 mm) with a surface of one ounce copper preferably coated with 0.00002 to 0.00003 inch (0.000508 to 0.000762 mm) of gold. This flexible board has sufficient physical memory so that when it is rolled into a small cylinder to fit into the cover of this switch, it tends to open up, that is, be biased against the inside surface of the cover and thereby remain in position without any adhesive being necessary. The board is metalized on one surface, has no plated-through holes and is a very simple element. As shown in FIG. 5, the board is approximately one inch (25.4 mm) long and has ten equal segment areas per track. For 8 or 16 position switches, the board would have 8 or 16 equal coding segments.

Kapton, Ryton 4, Valox and Paliney 7 are all trademarks of the suppliers of these particular products.

As to overall dimensions of the switch, the body is 0.380 inch (9.652 mm) square and stands 0.375 inch (9.525 mm) high off the surface of a printed circuit board when formed with stand-offs 63. These stand-offs are molded with the body to raise the bottom surface of the switch off the board to allow degassing during soldering and to allow flux cleaning thereafter. The terminals 14 projecting from the base have the standard dual-in-line 0.100 inch (2.54 mm) spacing longitudinally and are 0.300 inch (7.62 mm) between rows.

One of the major features of the invention is the employment of a cylindrical, rotating flexible printed circuit board, or a printed circuit surface on the inside of the cover, which makes contact with flexible wire form contacts to transfer the coded switching function to fixed, insert molded contact posts in the switch body. The flexible printed circuit board is self-contained in the drum-shaped rotatable cover. The cover provides several functions, including: (1) support and location of the flexible printed circuit board; (2) means for detenting the several available rotational positions of the switch; (3) annular means of actuating the switch by means of a screwdriver in the slot or by the fingers on the roughened external surface; and (4) external positional markings indicating the current rotational position of the switch. The transfer contacts, while loosely held in the holes in the cylindrical core portion of the body in the preferred embodiment shown, are longitudinally accurately located by being within annular grooves 24 molded into the core.

This switch is, in essence, a linear coded slide switch formed into a cylindrical configuration with the attendant advantages listed above. It is important to note that the switch of this invention provides simultaneous X and Y coding. That is, when the cover is rotated, switching is accomplished in the X direction along each of the tracks around the inside of the cover on the printed circuitry. Additionally, switching is also accomplished in the Y direction from track to track by the different terminals making electrical contact with the printed circuitry through the wire form contacts. It is likely that modifications and improvements will occur to those skilled in the art which are within the scope of this invention.

What is claimed is:

1. A rotary coded switch comprising:

a body member;

a cover rotatably mounted to said body member;

a plurality of terminals within said body member and projecting therefrom;

printed circuit means mounted to said cover and surrounding said body member, said printed circuit means rotating with said cover; and means for making sliding contact between said terminals and said printed circuit means for simultaneous selective coding circumferentially and longitudinally on the surface of said printed circuit means by said contact making means.

2. The switch recited in claim 1 wherein said body member comprises:

a base of substantially flat configuration; and a cylindrical core formed on one side of said base; said cover substantially enclosing said core.

3. The switch recited in claim 1 and further comprising means for rotatably mounting said cover to said body.

4. The switch recited in either of claims 1 or 2 wherein said cover has a cylindrical inner surface, said printed circuit means being closely adjacent said cylindrical inner surface.

5. The switch recited in claim 1 wherein said cover has a substantially cylindrical outer surface, said outer surface being roughened to facilitate manual rotation thereof.

6. The switch recited in claims 1 or 5 wherein said cover has a closed end, said closed end being formed with a slot adapted to receive a tool to facilitate rotation of said cover.

7. The switch recited in claims 1 or 5 wherein:

said cover is formed with equiangularly spaced visual indicia corresponding to positions of said switch; and said body is formed with polarity indicating means which cooperate with said visual indicia to indicate the position of said cover with respect to said body.

8. The switch recited in claim 6 wherein:

said cover is formed with equiangularly spaced visual indicia corresponding to positions of said switch; and said body is formed with polarity indicating means which cooperate with said visual indicia to indicate the position of said cover with respect to said body.

9. The switch recited in claim 1 wherein said terminals project from said body parallel with each other in dual-in-line configuration.

10. The switch recited in claims 1 or 2 wherein:

said cover is formed with a closed end; and said cover and said core are formed with mutually cooperating multiple position detenting means.

11. The switch recited in claims 1 or 2 wherein:

said cover is formed with a closed end;

said closed end has a longitudinally projecting annular ridge spaced from the inner surface of said cover, said printed circuit means comprises a flexible printed circuit board having one edge confined between said ridge and said inner surface.

12. The switch recited in claim 3 wherein:

said cover is formed with a closed end and an open end; and said means for rotatably mounting said cover to said body comprises cooperatively configured element on said body and said cover to provide a seal therebetween while permitting relative rotation, said cover being flexible relative to said body to facilitate such cooperative coupling.

13. The switch recited in claims 3 or 12 wherein:

said cover is formed with a closed end and an open end; and said means for rotatably mounting said cover to said body comprises an inwardly projecting circumferential rib located at said open end and a cooperating radially inwardly projecting annular groove on said body, said cover being sufficiently flexible to permit said cover to be placed over said body and for said rib to snap into said groove.

14. The switch recited in claims 1 or 2 wherein said printed circuit means comprises printed circuitry applied directly to the surface of said cover enclosing and closely adjacent said core.

15. The switch recited in claim 2 wherein said terminals are exposed at longitudinally spaced intervals along said core to provide access for said means for making contact.

16. The switch recited in claim 4 wherein said printed circuit means has selective metalized and non-metalized areas on the inner side thereof.

17. The switch recited in claim 4 wherein:

the inner surface of said cover is provided with an annular shoulder formed with at least one notch therein; and said printed circuit means comprises a flexible printed circuit board having one edge formed with a tab which engages said notch thereby facilitating rotation of said printed circuit board with said cover.

18. The switch recited in claim 4 wherein:

the inner surface of said cover is provided with an annular shoulder formed with at least one longitudinally projecting tab; and said printed circuit means comprises a flexible printed circuit board having one edge formed with a notch which engages said tab thereby facilitating rotation of said printed circuit board with said cover.

19. The switch recited in claim 2 and further comprising:

means for rotatably mounting said cover to said body; wherein said cover is formed with a closed end and an open end;

said rotatably mounting means comprises an inwardly projecting circumferential rib located at said open end and a cooperating radially inwardly projecting annular groove at the interface between said core and said base;

wherein when said rib resides in said groove, said cover abuts said base and substantially encloses said core.

20. The switch recited in claim 2 wherein said contact making means comprise a plurality of flexible contacts mounted to said core, said contacts being confined between said printed circuit means within said cover and the outer surface of said core and making contact between said terminals and said printed circuit means.

21. The switch recited in claim 20 wherein said flexible contacts are fixed to said terminals.

22. The switch recited in claim 20 wherein the outer surface of said core is formed with a plurality of annular grooves spaced by a plurality of annular lands, at least one longitudinal projection in each groove, each of said flexible contacts being snapped into said groove over said projection and being longitudinally confined within said groove between adjacent ones of said annular lands and being radially confined within said groove by said projection.

23. The switch recited in claim 20 wherein said core is formed with a plurality of holes into each of which one end of each said flexible contact projects thereby preventing angular movement of said flexible contacts with rotation of said cover.

24. The switch recited in claim 23 wherein the outer surface of said core is formed with a plurality of annular grooves spaced by a plurality of annular lands, there being at least one of said holes in each said groove, said flexible contacts being longitudinally confined within one of said grooves and between adjacent ones of said annular lands.

25. The switch recited in claim 10 wherein said closed end of said cover is formed with equiangularly spaced visual indicia, there being one of said indicia corresponding with each stable position of said switch and with each detent position.

26. The switch recited in claim 10 wherein:

said core is formed with an axial opening, a portion of which has a multiplicity of radially outwardly directed facets; and said closed end of said cover is formed with at least one flexible finger extending longitudinally toward the open end of said cover, said finger being formed with a radially extending surface adapted to engage said facets to maintain said cover in any one of a multiplicity of possible stable positions.

27. The switch recited in claim 26 wherein that portion of the free end of said flexible finger engaging said facets is equal to or less than one half of the length of said finger.

28. The switch recited in claim 26 wherein approximately one half of the length of the free end of said flexible finger engages said facets.

29. The switch recited in claim 28 wherein said facets extend from the end of said core adjacent said base to a point approximately half way up said core.

30. A rotary coded switch comprising:

a body member comprising:

a base of substantially flat configuration; and a cylindrical core formed with said base;

a plurality of terminals within said body projecting from said base and being exposed at spaced intervals along said cylindrical core;

a cylindrical cover substantially enclosing said core;

means for rotatably mounting said cover to said body;

a flexible printed circuit board closely adjacent the surface of said cover enclosing and closely adjacent said core, said board having metalized and non-metalized areas; and a plurality of contact means mounted to said core, each of said contact means engaging one of said terminals and slidingly engaging the inner surface of said printed circuit board;

whereby when said cover and said body are rotated with respect to each other, coded switching functions are performed with respect to said terminals as said contacts engage different metalized areas of said printed circuit board and simultaneously provide circumferential and longitudinal switch coding as the relative rotation occurs.

31. A rotary coded switch comprising:

a body member comprising:

a base of substantially flat configuration; and a cylindrical core formed on one side of said base;

a cover rotatably mounted to said body member and substantially enclosing said core;

a plurality of terminals within said body member and projecting therefrom;

printed circuit means within said cover in cylindrical configuration, said printed circuit means rotating with said cover; and means for making contact between said terminals and said printed circuit means, wherein said contact making means comprises a plurality of flexible contacts mounted to said core, said contacts being confined between said printed circuit means within said cover and the outer surface of said core and making contact between said terminals and said printed circuit means.

32. The switch recited in claim 31 wherein said core is formed with a plurality of holes into each of which one end of each said flexible contact projects thereby preventing angular movement of said flexible contacts with rotation of said cover.

33. The switch recited in claim 32 wherein the outer surface of said core is formed with a plurality of annular grooves spaced by a plurality of annular lands, there being at least one of said holes in each said groove, said flexible contacts being longitudinally confined within one of said grooves and between adjacent ones of said annular lands.

34. The switch recited in claim 31 wherein said flexible contacts are fixed to said terminals.

35. A rotary coded switch comprising:

a body member;

a cover rotatably mounted to said body member;

a plurality of terminals within said body member and projecting therefrom;

printed circuit means within said cover in cylindrical configuration, said printed circuit means rotating with said cover; and means for making contact between said terminals and said printed circuit means;

wherein said cover has a cylindrical inner surface, said printed circuit means being closely adjacent said cylindrical inner surface, said inner surface being provided with an annular shoulder formed with at least one notch therein, said printed circuit means comprising a flexible printed circuit board having one edge formed with a tab which engages said notch thereby facilitating rotation of said circuit board with said cover.

36. A rotary coded switch comprising:

a body member comprising:

a base of substantially flat configuration; and a cylindrical core formed on one side of said base;

a cover rotatably mounted to said body member, said cover substantially enclosing said core and having a cylindrical inner surface;

a plurality of terminals within said body member and projecting therefrom;

printed circuit means within said cover in cylindrical configuration, said printed circuit means rotating with said cover and being closely adjacent said cylindrical inner surface of said cover; and means for making contact between said terminals and said printed circuit means;

wherein the inner surface of said cover is provided with an annular shoulder formed with at least one notch therein, said printed circuit means comprising a flexible printed circuit board having one edge formed with a tab which engages said notch thereby facilitating rotation of said printed circuit board with said cover.

37. A rotary coded switch comprising:

a body member;

a cover rotatably mounted to said body member;

a plurality of terminals within said body member and projecting therefrom;

printed circuit means within said cover in cylindrical configuration, said printed circuit means rotating with said cover; and means for making contact between said terminals and said printed circuit means;

wherein said cover has a cylindrical inner surface, said printed circuit means being closely adjacent said cylindrical inner surface, said inner surface being provided with an annular shoulder formed with at least one longitudinally projecting tab, said printed circuit means comprising a flexible printed circuit board having one edge formed with a notch which engages said tab thereby facilitating rotation of said circuit board with said cover.

38. A rotary coded switch comprising:

a body member comprising:

a base of substantially flat configuration; and a cylindrical core formed on one side of said base;

a cover rotatably mounted to said body member, said cover substantially enclosing said core and having a cylindrical inner surface;

a plurality of terminals within said body member and projecting therefrom;

printed circuit means within said cover in cylindrical configuration, said printed circuit means rotating with said cover and being closely adjacent said cylindrical inner surface of said cover; and means for making contact between said terminals and said printed circuit means;

wherein the inner surface of said cover is provided with an annular shoulder formed with at least one longitudinally projecting tab, said printed circuit means comprising a flexible printed circuit board having one edge formed with a notch which engages said tab thereby facilitating rotation of said printed circuit board with said cover.

39. A rotary coded switch comprising:

a body member;

a cover rotatably mounted to said body member and formed with a closed end, said cover and said body member being formed with mutually cooperating multiple position detenting means;

a plurality of terminals within said body member and projecting therefrom, said body member being formed with an axial opening, a portion ofwhich has a multiplicity of radially outwardly directed facets, said closed end of said cover being formed with at least one flexible finger extending longitudinally toward the open end of said cover, said finger being formed with a radially extending surface adapted to engage said facets to maintain said cover in any one of a multiplicity of possible stable positions;

printed circuit means within said cover in cylindrical configuration, said printed circuit means rotating with said cover; and means for maintaining contact between said terminals and said printed circuit means.

40. A rotary coded switch comprising:

a body member comprising:

a base of substantially flat configuration; and a cylindrical core formed on one side of said base;

a cover rotatably mounted to said body member, said cover being formed with a closed end and substantially enclosing said core, said cover and said core being formed with a mutually cooperating multiple position detenting means, said core being formed with an axial opening, a portion of which has a multiplicity of radially outwardly directed facets, said closed end of said cover being formed with at least one flexible finger extending longitudinally toward the open end of said cover, said finger being formed with a radially extending surface adapted to engage said facets to maintain said cover in any one of a multiplicity of possible stable positions;

a plurality of terminals within said body member and projecting therefrom;

printed circuit means within said cover in cylindrical configuration, said printed circuit means rotating with said cover; and means for making contact between said terminals and said printed circuit means.

41. The switch recited in either of claims 39 or 40 wherein approximately one half of the length of the free end of said flexible finger engages said facets.

42. The switch recited in claim 41 wherein said facets extend from the end of said core adjacent said base to a point approximately half way up said core.

43. The switch recited in either of claims 39 or 40 wherein that portion of the free end of said flexible finger engaging said facets is equal to or less than one half of the length of said finger.

44. A rotary coded switch comprising:

a body member;

a cover formed with a closed end and being rotatably mounted to said body member;

a plurality of terminals within said body member and projecting therefrom;

printed circuit means within said cover in cylindrical configuration, said printed circuit means rotating with said cover, said closed end of said cover having a longitudinally projecting annular ridge spaced from the inner surface of said cover, said printed circuit means comprising a flexible printed circuit board having one edge confined between said ridge and said inner member; and means for maintaining contact between said terminals and said printed circuit means.

45. A rotary coded switch comprising:

a body member comprising:

a base of substantially flat configuration; and a cylindrical core formed on one side of said base;

a cover rotatably mounted to said body member and substantially enclosing said core, said cover being formed with a closed end;

a plurality of terminals within said body member and projecting therefrom;

printed circuit means within said cover in cylindrical configuration, said printed circuit means rotating with said cover, said closed end of said cover having a longitudinally projecting annular ridge spaced from the inner surface of said cover, said printed circuit means comprising a flexible printed circuit board having one edge confined between said ridge and said inner surface; and means for maintaining contact between said terminals and said printed circuit means.

46. A rotary coded switch comprising:

a body member;

a cover rotatably mounted to said body member, said cover being formed with a closed end and an open end;

means for rotatably mounting said cover to said body comprising cooperatively configured elements on said body and said cover to provide a seal therebetween while permitting relative rotation, said cover being flexible relative to said body to facilitate cooperative coupling;

a plurality of terminals within said body member and projecting therefrom;

printed circuit means within said cover in cylindrical configuration, said printed circuit means rotating with said cover; and means for making contact between said terminals and said printed circuit means.

47. The switch recited in claim 46 wherein said means for rotatably mounting said cover to said body comprises an inwardly projecting circumferential rib located at said open end and a cooperating radially inwardly projecting annular groove on said body, said cover being sufficiently flexible to permit said cover to be placed over said body and for said rib to snap into said groove.

48. A rotary coded switch comprising:

a body member;

a cover rotatably mounted to said body member, said cover being formed with a closed end and an open end;

means for rotatably mounting said cover to said body, said means comprising an inwardly projecting circumferential rib located at said open end and a cooperating radially inwardly projecting annular groove on said body, said cover being sufficiently flexible to permit said cover to be placed over said body and for said rib to snap into said groove;

a plurality of terminals within said body member and projecting therefrom;

printed circuit means within said cover in cylindrical configuration, said printed circuit means rotating with said cover; and means for making contact between said terminals and said printed circuit means.

49. A rotary coded switch comprising:

a body member comprising:

a base of substantially flat configuration; and a cylindrical core formed on one side of said base;

a cover rotatably mounted to said body, said cover being formed with a closed end and an open end;

means for rotatably mounting said cover to said body comprising an inwardly projecting circumferential rib located at said open end and a cooperating radially inwardly projecting annular groove at the interface between said core and said base, wherein said rib resides in said groove, said cover abuts said base and substantially encloses said core;

a plurality of terminals within said body member and projecting therefrom;

printed circuit means within said cover in cylindrical configuration, said printed circuit means rotating with said cover; and means for making contact between said terminals and said printed circuit means.

* * * * *